United States Patent [19]

Sakata et al.

[11] 4,323,600

[45] Apr. 6, 1982

[54] PROCESS FOR METALLIC COAT FINISHING

[75] Inventors: Kenji Sakata, Kamakura; Toshiaki Yamada, Yokohama; Kenji Uchiyama, Odawara; Yugo Hasegawa, Yokohama, all of Japan

[73] Assignee: Mitsui Toatsu Chemicals, Inc., Tokyo, Japan

[21] Appl. No.: 176,155

[22] Filed: Aug. 7, 1980

[30] Foreign Application Priority Data

Aug. 7, 1979 [JP] Japan ..... 54-99907

[51] Int. Cl.[3] ..... B05D 1/36

[52] U.S. Cl. ..... 427/202; 427/205; 427/195; 427/407.1; 428/461; 428/521

[58] Field of Search ..... 427/195, 205, 202, 203, 427/407.1; 428/216, 461, 463, 520, 522, 328

[56] References Cited

U.S. PATENT DOCUMENTS

| | | | |
|---|---|---|---|
| 3,860,563 | 1/1975 | Katsimbas et al. | 428/463 X |
| 3,953,644 | 4/1976 | Camelon et al. | 427/195 X |
| 4,139,672 | 2/1979 | Ozawa et al. | 427/195 X |
| 4,220,675 | 9/1980 | Imazaki . | |
| 4,220,679 | 9/1980 | Backhouse | 427/407.1 |

*Primary Examiner*—Shrive P. Beck

*Attorney, Agent, or Firm*—Sughrue, Mion, Zinn, Macpeak and Seas

[57] ABSTRACT

Metallic coat finishing with good gloss vividness is provided by undercoating a liquid coating containing a specified thermosetting vinyl copolymer and a metallic appearance imparting pigment, overcoating a thermosetting, clear powder paint and then baking the two coated film together. The specified thermosetting vinyl copolymer is obtained by copolymerizing N-alkoxymethyl(metha)-acrylic amide, a hydroxyl group containing vinyl monomer, a carboxyl group containing vinyl monomer and copolymerizable other vinyl monomers in specified amounts.

9 Claims, No Drawings

PROCESS FOR METALLIC COAT FINISHING

BACKGROUND OF THE INVENTION

This invention relates to a process for metallic coat finishing, having good gloss vividness, particularly metallic glossy effect, by a so-called two coats-one bake system.

For the purpose of prevention of environmental pollution the coat finishing by a non-solvent, powder paint has rapidly been developing in recent years. However, in the coat finishing using only the powder paint having metal powders or colored pigments incorporated therein, owing to insufficient orientation of the metal powders in the coated film it is very difficult to obtain the coat of gloss vividness and smoothness equal to conventional solvent type metallic coatings. Therefore this coat finishing is not yet used in practice.

The gloss vividness used herein means a combined appearance of visible glossy effect and metallic glossy effect when the coat is observed by the naked eyes.

In case of using the conventional solvent type metallic coatings or aqueous metallic coatings, a coat finishing by applying the metallic coating, then effecting a pre-drying or bake-hardening, overcoating a thermosetting, clear powder paint and baking, i.e. a so-called two coats-two bakes system is disclosed in, for example, U.S. Pat. No. 4,142,018 and Japanese Patent Kokai No. 52-69446. This system, however, requires another baking furnace because of the two baking steps and also, is uneconomical in view of saving the energy.

For solving the above disadvantages, a coat finishing by applying the conventional metallic coating, then overcoating a thermosetting, clear powder paint and bake-hardening, i.e. a so-called two coats-one bake system is disclosed in, for example, Japanese Patent Kokai Nos. 54-4934 and 54-25943.

In the former a thermosetting resin containing as a cross-linking agent a monohydroxyl compound-denatured melamine-formaldehyde resin is used as a coated film forming component, whereas in the latter a high boiling solvent having a boiling point above the baking temperature minus 80° C., its solubility parameter being within the range of $\pm 1.2$ of the solubility parameter of the resin in a top coat powder paint is used for a high boiling component of a solvent mixture contained in a solvent type thermosetting coating.

These methods, however, result in lowering of the gloss vividness and smoothness of the coat and cause serious problems in practical uses.

SUMMARY OF THE INVENTION

An object of this invention is to provide a process for metallic coat finishing by the two coats-one bake system having economical advantages.

Another object of this invention is to provide metallic coat finishing with good gloss vividness rated by visible glossy effect, metallic glossy effect and 60° gloss according to a 60° mirror reflection method, and improved smoothness free of orange peel, pinholes and craters.

The foregoing can be attained by undercoating a substrate with a liquid coating (A) comprising a thermosetting vinyl copolymer (a) of 5,000–30,000 in number average molecular weight and a pigment (b) imparting metallic appearance to the coat, overcoating with a clear thermosetting powder paint (B) and thereafter baking the two coated films together, said thermosetting vinyl copolymer (a) being obtained by copolymerizing 3–25% by weight of N-alkoxymethyl(metha)acrylic amide, 3–20% by weight of a hydroxyl group containing vinyl monomer, 0.5–5% by weight of a carboxyl group containing vinyl monomer and 50–93.5% by weight of copolymerizable other vinyl monomers.

DETAILED DESCRIPTION OF THE INVENTION

In accordance with this invention, there is provided a new process for metallic coat finishing by the two coats-one bake system comprising a combination of a thermosetting liquid coating (A) containing a metallic appearance imparting pigment (hereinafter referred to as a base coat paint) with a clear thermosetting powder paint (B) (hereinafter referred to as a top coat paint), characterized by using the thermosetting vinyl copolymer resin (a) of specific composition as defined above.

The N-alkoxymethyl(metha)acrylic amides which may be used in this invention are those having a straight chain or branched alkyl group of 1–8 carbon atoms. The examples include N-methoxymethyl(metha)acrylic amide, N-ethoxymethyl(metha)acrylic amide, N-propoxymethyl(metha)acrylic amide, N-butoxymethyl(metha)acrylic amide and others.

The amount of these compounds of one or more involved in the copolymer (a) is connected with a crosslinking density of the coated film when baked.

The amount is less than 3% by weight based on the material composition, the crosslinking density of the baked coat is insufficient so that desired properties (e.g. water resistance and chemical resistance) and gloss vividness are not obtained.

On the other hand the amount exceeding 25% by weight based on the material composition results in lowering of the gloss vividness of the baked coat.

Preferably, the amount of N-alkoxymethyl(metha)acrylic amides is comprised between 10% and 25% by weight.

In this invention, the vinyl monomers of the hydroxyl group containing vinyl monomer, the carboxyl group containing vinyl monomer and the copolymerizable other vinyl monomers are $\alpha,\beta$ unsaturated ethylenical monomers copolymerizable one another (hereinafter referred to merely as "vinyl monomer").

The hydroxyl group containing vinyl monomers are those having at least one hydroxyl group in the molecule. The examples are acrylic vinyl monomers such as 2-hydroxyethyl acrylate or methacrylate, 2-hydroxypropyl acrylate or methacrylate, 3-hydroxypropyl acrylate or methacrylate, 4-hydroxybutyl acrylate or methacrylate and di(2-hydroxyethyl)fumarate.

When the amount of the hydroxyl group containing vinyl monomer is less than 3% by weight based on the material composition, the gloss vividness of the baked coat is insufficient.

On the other hand, when exceeding 20% by weight, the gloss vividness of the baked coat is reduced and desired properties (e.g. water resistance) are not obtained.

Preferably, the amount is comprised between 5% and 15% by weight based on the material composition.

The carboxyl group containing vinyl monomers are those having at least one carboxyl group in the molecule. The examples are acrylic acid, methacrylic acid, itaconic acid, maleic acid and others.

When the amount of the carboxyl group containing vinyl monomer is less than 0.5% by weight based on the material composition, the crosslinking density of the baked coat is insufficient and desired properties (e.g. water resistance and chemical resistance) are not obtained. On the other hand, the amount exceeding 5% by weight results in lowering of the gloss vividness of the baked coat.

Preferably, the amount is within the range of 1-3% by weight based on the material composition.

The copolymerizable other vinyl monomers are alkyl esters of acrylic acid and methacrylic acid, the alkyl group of which is a straight chain or branched hydrocarbon of 1-13 carbon atoms, for example, methyl, ethyl, propyl, butyl, 2-ethylhexyl, isodecyl, cyclohexyl, lauryl and others.

Further, copolymerizable other vinyl monomers which may be used are styrene and its derivatives, acrylonitrile, methacrylonitrile, glycidyl acrylate or methacrylate and others.

The thermosetting vinyl copolymer (a) may be prepared by copolymerizing the N-alkoxymethyl(metha)acrylic amide, the hydroxyl group containing vinyl monomer, the carboxyl group containing vinyl monomer and the copolymerizable other vinyl monomers in the amounts as defined above till copolymers of 5,000-30,000, preferably 6,000-20,000 in number average molecular weight are obtained. Usually, solution polymerization is carried out in the presence of a chain transfer agent and a polymerization initiator.

The polymerization temperature is within, preferably the range of 60°-150° C., though the polymerization is conducted at temperatures according to types of the monomer, solvent and initiator. It should be, however, noticed that the polymerization process and the addition order or monomers for the preparation of the thermosetting vinyl copolymers are not limited in this invention.

When the number average molecular weight of the thermosetting vinyl copolymer (a) is less than 5,000, the baked coat is inferior in the gloss vividness, particularly metallic glossy effect. On the other hand, when the number average molecular weight is more than 30,000, the workability of spray coating is reduced (e.g. formation of fine particles and unevenness in the spray coating).

Solvents for the solution polymerization for preparing the copolymer (a) are, for example, acetic acid esters such as ethyl acetate or butyl acetate, aromatic hydrocarbons such as toluene or xylene, alcohols such as ethanol, propanol or butanol, ketones such as acetone or methyl ethyl ketone and cellosolves such as methyl cellosolve or butyl cellosolve. They may be used alone or in mixture.

A chain transfer agent, for example mercaptans such as n-dodecylmercaptan, tert-dodecylmercaptan and 2-mercaptoethanol may be used, if desired.

As to the polymerization initiator, conventional catalysts, for example diazo compounds such as azobisisobutylonitrile and peroxides such as benzoylperoxide or cumenehydroperoxide may be used.

The metallic appearance imparting pigment (b) which may be used in this invention means pigments that are normally used in the art. Examples include aluminum powders of non-leafing or leafing type, bronze powders, copper powders, mica powders and others. They may be used in form of fine flakes or foils.

The base coat paint (A) of this invention is obtained by mixing the above-mentioned vinyl copolymer (a) with metallic appearance imparting pigment (b) and if desired, coloring materials such as an inorganic pigment, an organic pigment or an oil-soluble dye and additives, e.g. a dispersing assistant, a curing accelerator and a flow control agent, which are used in conventional coatings. Though the vinyl copolymer (a) is usually incorporated without a curing agent, aminoplast resins such as methylated melamine-formaldehyde resin and butylated melamine-formaldehyde resin may be occasionally used within limits not reducing the gloss vividness of the coated film.

Next, the top coat paint (B) which may be used in this invention is powder paints containing a thermosetting resin powder (inclusive of a crosslinking agent and a curing agent) as the main component and if desired, additives, coloring materials and others.

For example, paints containing known thermosetting acrylic resins or thermosetting polyester resins as the main component are preferred, though this invention is not limited to the exemplified resins only.

By way of example using the thermosetting acrylic resin, vinyl copolymers of 50°-80° C. in glass transition temperature are prepared by copolymerizing functional monomers such as glycidyl methacrylate or glycidyl methacrylate or glycidyl acrylate and non-functional monomers such as alkyl esters of acrylic or methacrylic acid and styrene in accordance with known copolymerization processes.

To the obtained vinyl copolymer are added a polycarboxylic acid as the curing agent, a flow control agent and an anticratoring agent and thus, the top coat paint (B) is prepared by conventional methods for the preparation of powder paints.

The following is illustrative of the coat finishing according to this invention.

First, the base coat paint (A) is adjusted to a viscosity of 10-100 cps/25° C. by indicated diluent solvents and then, applied by air spraying or electrostatic painting on a substrate which has preliminarily been coated with a primer, e.g. cationic or anionic electrodeposition coatings in such a manner that the coated film has a thickness of 10-40$\mu$, preferably 10-30$\mu$ based on the dry.

After allowing to stand at normal temperature for 1-30 minutes, the top coat paint (B) is applied by electrostatic painting in such a manner that the baked coat has a thickness of 30-150$\mu$, preferably 50-150$\mu$ and set at normal temperature for 0-30 minutes.

Then the top coat and the base coat are hardened simultaneously by baking 150°-220° C., preferably 150°-200° C. for 10-45 minutes and thus, metallic coat finishing is obtained with improved gloss vividness.

This invention will be illustrated by the following non-limitative examples. The percents and parts are indicated by weight unless indicated otherwise.

EXAMPLE 1

(1) Preparation of Base Coat Paint (A)

To a three-necked flask provided with a stirrer, a reflux condenser and a thermometer were added 80 parts of xylene, 20 parts of butanol, a monomer mixture of 10 parts of N-butoxymethylacrylic amide, 7 parts of 2-hydroxyethyl methacrylate, 3 parts of methacrylic acid, 10 parts of styrene, 40 parts of methyl methacrylate, 15 parts of butyl acrylate and 15 parts of 2-ethylhexyl acrylate, and 1.5 parts of benzoylperoxide.

Reaction was conducted at 90° C. for 8 hours while adding 0.2 parts of benzoylperoxide every two hours. The obtained acrylic resin (Copolymer (a) of this invention) has a solid content of 50% and number average molecular weight of 15,000.

To 200 parts of the acrylic resin (a) (solid content 50%) were added 10 parts of non-leafing type aluminum powders (b) (1109MA, the tradename by Toyo Aluminum Comp., Japan) and a solvent mixture consisting of 80 parts of xylene and 20 parts of butanol and then, adjusted to a viscosity of 50 cps/25° C. to form the base coat paint (A) of this invention.

(2) Preparation of Top Coat Paint (B)

15 parts of styrene, 48 parts of methyl methacrylate, 18 parts of n-butyl acrylate, 19 parts of glycidyl methacrylate and 100 parts of toluene were charged into a three-necked flask provided with a stirrer and a reflux condenser and further, 1.5 parts of azobisisobutylonitrile were added. The contents were heated to temperatures of 85°-95° C.

After maintaining same temperature for three hours, 1.5 parts of azobisisobutylonitrile were further added and same temperature was maintained for 4 hours to complete copolymerization.

Then a condenser tube was equipped to the flask to flow the condensed solvent out to the outside of the flask and stirring was effected while heating at external temperatures of 120°-140° C.

Thereafter the inside pressure of the flask was reduced to about 200 mm Hg and the external temperature was elevated to 140°-150° C. thereby to almost completely remove the remaining toluene.

The copolymer thus obtained was cooled and solidified and then, pulverized by a mill to obtain acrylic resin powders.

The formulation of:

| | |
|---|---|
| Acrylic resin powders | 100 parts |
| Decanedicarboxylic acid | 16 parts |
| Flow control agent (Regimix P, the tradename by Mitsui Toatsu Chemicals) | 1 part |

was melted and kneaded at about 100° C. by a heat roller for ten minutes, then cooled and pulverized to particle sizes of 20-100μ to prepare the top coat powder paint (B) of this invention.

(3) Coat Finishing

A surface-treated stainless steel plate on which an electrodeposition primer of an epoxy-ester resin type had been applied was coated with the above base coat paint (A) having the viscosity adjusted to about 50 cps/25° C. by an air spray gun in such a manner that the coated film had a thickness of 15-20μ based on the dry.

After allowing to stand at normal temperature for three minutes the above top coat paint (B) was applied by electrostatic spray painting in such a manner that the coat after baking had thickness of 60-100μ. After setting ten minutes, baking was conducted in a hot air drier at 170° C. for 20 minutes whereby the two coated films were hardened simultaneously and thus, samples for tests were obtained.

(4) Rating on Test Samples

A smoothness and gloss vividness of coated surface were rated on the test samples prepared above as follows: As for the smoothness the presence of orange peel, pinholes and craters owing to foaming was observed by the naked eyes.

As for the gloss vividness, visible glossy effect and metallic glossy effect were observed by the naked eyes. Also, using a glossmeter, a 60° mirror reflection test was made in accordance with the gloss measurement method of JIS Z8741 and the measurement value was indicated as "60° gloss". It is said that the value of more than 90% is desirable in practice.

The test results are given in Table 3.

EXAMPLE 2

Using the following formulation, the base coat paint (A) was prepared in the same procedure as in Example 1.

| | |
|---|---|
| Acrylic resin (a) of Example 1 | 190 parts |
| Methylated melamine resin (Cymel 325, the tradename by Mitsui Toatsu Chemicals) | 10 parts |
| Non-leafing type aluminum powders (1109 MA, mentioned above) | 10 parts |

Using the base coat paint (A) thus obtained and the top coat paint (B) prepared in Example 1, the preparation of test samples and the rating thereon were conducted in the same procedure as in Example 1 .

The test results are given in Table 3.

EXAMPLES 3-5

In the same manner as in Example 1, vinyl copolymers (a) were prepared with the composition set forth in Table 1 and then, the base coat paint (A) was prepared.

TABLE 1

| | | Example 3 | Example 4 | Example 5 |
|---|---|---|---|---|
| Composition of Copolymers (a) | N-alkoxymethyl acrylic amides | N-butoxymethyl acrylic amide 15 parts | N-methoxymethyl acrylic amide 7 parts | N-butoxymethyl acrylic amide 20 parts |
| | Hydroxyl group cont'ng vinyl monomers | 2-Hydroxyethyl methacrylate 5 parts | 2-Hydroxypropyl 2-Hydroxyethyl methacrylate 10 parts | acrylate 15 parts |
| | Carboxyl group cont'ng vinyl monomers | Methacrylic acid 2.5 parts | Acrylic acid 2 parts | Itaconic acid 1.5 parts |
| | Other vinyl monomers | Methyl methacrylate 47.5 parts Ethyl acrylate 20 parts n-Butyl methacrylate 10 parts | Methyl methacrylate 40 parts Butyl acrylate 31 parts 2-Ethylhexyl methacrylate 10 parts | Methyl methacrylate 33.5 parts 2-Ethylhexyl acrylate 15 parts Isobutyl methacrylate 15 parts |

TABLE 1-continued

| | Example 3 | Example 4 | Example 5 |
|---|---|---|---|
| Number Average Molecular Weight of Copolymers (a) | 12,000 | 10,000 | 18,000 |

COMPARATIVE EXAMPLE 1

In the same procedure as in Example 1, 70 parts of xylene, 30 parts of butanol, 30 parts of N-butoxymethylacrylic amide, 22 parts of hydroxyethyl methacrylate, 1.0 part of methacrylic acid, 30 parts of methyl methacrylate and 17 parts of ethyl acrylate were reacted in the presence of 1.5 parts of benzoylperoxide to obtain an acrylic resin of 13,000 in number average molecular weight.

In the same manner as in Example 1, the base coat paint was prepared using the acrylic resin thus obtained and similarly, the test samples were prepared.

The test results are given in Table 3.

COMPARATIVE EXAMPLE 2

The base coat paint was prepared with the following formulation in the same manner as in Example 1.

| | |
|---|---|
| Acrylic resin of Comparative Ex. 1 | 190 parts |
| Methylated melamine resin (Cymel 325, mentioned above) | 10 parts |
| Non-leafing type aluminum powders (1109 MA, mentioned above) | 10 parts |

Test samples were prepared and rated in the same manner as in Example 1.

The results are given in Table 3.

COMPARATIVE EXAMPLES 3-5

Copolymers with the composition set forth in Table 2, which are outside the scope of this invention were prepared in the same manner as in Comparative Example 1.

In these Examples, since the amount of the crosslinking component (i.e. N-alkoxymethyl(metha)acrylic amides) is small or zero, a curing agent was incorporated in the preparation of the base coat paint.

| | |
|---|---|
| Acrylic copolymer, solid content 50% | 160 parts |
| 50% Butylated methylol melamine resin (Uvan 20SE, the tradename by Mitsui Toatsu Chemicals) | 40 parts |
| Non-leafing type aluminum powders (1109 MA, mentioned above) | 10 parts |

Using the base coat paint thus obtained and the top coat paint prepared in Example 1, test samples were prepared and rated in the same manner as in Example 1.

The results are given in Table 3.

TABLE 2

| | | Comp. Ex. 3 | Comp. Ex. 4 | Comp. Ex. 5 |
|---|---|---|---|---|
| Composition of Copolymers | N-alkoxymethyl-(metha)acrylic amides | 0 | 0 | N-butoxymethyl-acrylic amide 1.0 part |
| | Hydroxyl group cont'ng vinyl monomers | 2-Hydroxyethyl methacrylate 10 parts | 2-Hydroxyethyl acrylate 25 parts | 2-Hydroxypropyl methacrylate 5 parts |
| | Carboxyl group cont'ng vinyl monomers | Methacrylic acid 2 parts | Acrylic acid 3 parts | Itaconic acid 1 part |
| | Other vinyl monomers | Styrene 10 parts<br>Methyl methacrylate 40 parts<br>Butyl acrylate 38 parts | Methyl methacrylate 40 parts<br>Ethyl acrylate 22 parts<br>n-Butyl methacrylate 10 parts | Methyl methacrylate 45 parts<br>Ethyl acrylate 48 parts |
| Number Average Molecular Weight of Copolymers | | 10,000 | 18,000 | 22,000 |

TABLE 3

| Ex. Number | Average Thickness of Base Coat | Average Thickness of Top Coat | Smoothness | Gloss Vividness: Visible Glossy Effect | Gloss Vividness: Metallic Glossy Effect | 60° Gloss |
|---|---|---|---|---|---|---|
| Example | | | | | | |
| 1 | 18 | 67 | A | A | A | 96% |
| 2 | 17 | 74 | A | A | A | 93% |
| 3 | 20 | 70 | A | A | A | 95% |
| 4 | 21 | 75 | A | A | A | 98% |
| 5 | 19 | 73 | A | A | A | 90% |
| Comparative Example | | | | | | |
| 1 | 20 | 68 | B | B | C | 65% |
| 2 | 18 | 88 | C | C | C | 51% |
| 3 | 19 | 72 | C | C | C | 30% |
| 4 | 21 | 79 | C | C | C | 20% |

TABLE 3-continued

| Ex. Number | Average Thickness of Base Coat | Average Thickness of Top Coat | Smoothness | Gloss Vividness | | |
|---|---|---|---|---|---|---|
| | | | | Visible Glossy Effect | Metallic Glossy Effect | 60° Gloss |
| 5 | 22 | 81 | C | C | C | 40% |

Note:
A Good,
B Poor,
C Very poor

What is claimed is:

1. A process for metallic coat finishing which comprises (1) undercoating a substrate with a liquid coating (A) comprising a thermosetting vinyl copolymer (a) of 5,000–30,000 in number average molecular weight and a pigment (b) imparting a metallic appearance to the coating to form a first coated film, (2) without baking the first coated film obtained as in step (1), overcoating said coated film obtained as in step (1) with a clear thermosetting powder paint (B) to form a second coated film and thereafter, (3) baking the two coated films together, said thermosetting vinyl copolymer (a) being obtained by copolymerizing 3–25% by weight of N-alkoxymethyl(metha)acrylic amide, 3–20% by weight of a hydroxyl group containing vinyl monomer, 0.5–5% by weight of a carboxyl group containing vinyl monomer and 50–93.5% by weight of copolymerizable other vinyl monomers.

2. The process of claim 1 wherein said N-alkoxymethyl(metha)acrylic amide is within the range of 10–25% by weight.

3. The process of claim 1 wherein said hydroxyl group containing vinyl monomer is within the range of 5–15% by weight.

4. The process of claim 1 wherein said carboxyl group containing vinyl monomer is within the range of 1–3% by weight.

5. The process of claim 1 wherein said number average molecular weight is between 6,000 and 20,000.

6. The process of claim 1 wherein said metallic appearance imparting pigment is aluminum powders.

7. The process of claim 1 wherein said clear thermosetting powder paint is a thermosetting acrylic resin.

8. The process of claim 1 wherein said liquid coating (A) is applied in such a manner that the coated film has an average thickness of 10–40$\mu$ on a dried basis.

9. The process of claim 1 wherein said clear thermosetting powder paint (B) is applied in such a manner that the baked coat has an average thickness of 30–150$\mu$.

* * * * *